US005318713A

United States Patent [19]

Binter

[11] Patent Number: 5,318,713

[45] Date of Patent: Jun. 7, 1994

[54] SOLID DETERGENT COMPOSITION WITH MULTI-CHAMBERED CONTAINER

[76] Inventor: Randolph K. Binter, 928 Fernwood, Moorestown, N.J. 08057

[21] Appl. No.: 894,258

[22] Filed: Jun. 8, 1992

[51] Int. Cl.[5] ..... C11D 17/00; C11D 3/02; C11D 3/06; C11D 3/08

[52] U.S. Cl. ..... 252/90; 252/92; 252/135; 252/156; 252/179.15; 252/99; 200/552

[58] Field of Search ..... 252/90, 92, 135, 156, 252/174.15, 99; 206/552

[56] References Cited

U.S. PATENT DOCUMENTS

| | | | |
|---|---|---|---|
| Re. 32,818 | 1/1989 | Fernholz et al. | 252/90 |
| 2,164,092 | 6/1939 | Smith | 23/107 |
| 2,333,444 | 11/1943 | Robinson | 252/135 |
| 2,382,163 | 8/1945 | MacMahon | 252/135 |
| 2,382,165 | 8/1945 | MacMahon | 252/135 |
| 2,804,432 | 8/1957 | Bomewitz et al. | 252/156 |
| 2,987,483 | 6/1961 | Brooker | 252/135 |
| 3,417,024 | 12/1968 | Goldwasser | 252/135 |
| 3,639,286 | 2/1972 | Ballestra et al. | 252/109 |
| 3,649,545 | 3/1972 | Susuki et al. | 252/174 |
| 3,727,889 | 4/1973 | Nagel | 259/1 R |
| 4,171,546 | 10/1979 | Dirksing | 4/228 |
| 4,219,435 | 8/1980 | Biard et al. | 252/90 |
| 4,237,024 | 12/1980 | Fedechko | 252/99 |
| 4,426,362 | 1/1984 | Copeland et al. | 422/263 |
| 4,569,780 | 2/1986 | Fernholz et al. | 252/90 |
| 4,595,520 | 6/1986 | Heile et al. | 252/160 |
| 4,606,775 | 8/1986 | Robinson et al. | 134/18 |
| 4,846,989 | 7/1989 | Killa | 252/99 |
| 4,913,832 | 4/1990 | Kruse et al. | 252/99 |

FOREIGN PATENT DOCUMENTS

| | | | |
|---|---|---|---|
| 3541146 | 5/1927 | Fed. Rep. of Germany | 252/90 |
| 2258899 | 3/1989 | Japan | 252/90 |

*Primary Examiner*—Paul Lieberman
*Assistant Examiner*—Michael Tierney
*Attorney, Agent, or Firm*—Woodcock Washburn Kurtz Mackiewicz & Norris

[57] ABSTRACT

A detergent package containing a solid cast detergent for use in ware and hard surface washing applications. The cast detergent contains alkaline chemicals and a phosphate-based sequestering agent. The cast detergent preferably contains less than about 25% by weight of an alkali metal hydroxide and at least about 30% by weight of fused alkali metal orthosilicate as the alkaline chemical. The cast detergent is solid at room temperature and is surrounded on all but one surface by a multi-chambered receiver. The receiver is separated into a plurality of compartments in order to separate the alkaline chemicals and the phosphate-based sequestering agent and other chemically incompatible detergent compounds.

15 Claims, 1 Drawing Sheet

SOLID DETERGENT COMPOSITION WITH MULTI-CHAMBERED CONTAINER

FIELD OF THE INVENTION

This invention relates to a novel solid cast detergent containing package useful in ware and hard surface washing applications.

DESCRIPTION OF RELATED ART

Solid alkaline detergent compositions are commonly used in many commercial and residential washing applications. Such applications include ware and hard surface washing, such as dishwashing. The solid detergent compositions are either in the form of powders, granules, pellets, tablets, or casts. Casts are preferred over the other forms of solid detergent compositions in part because of the expensive production systems, such as pelletizing systems, grinders, etc., required in the manufacture of non-cast solid detergents. The cast detergents also provide an increased level of safety in comparison to the other solid detergent forms.

Solid cast compositions typically contain an alkaline source such as alkaline metal hydroxides and/or silicates. The need for higher alkalinity in the cast detergent has increased in recent years due to a desire to decrease the wash time in high volume industrial uses. The solid cast detergent compositions generally further contain a hardness sequestering agent for conditioning hard water. Examples of sequestering agents include polyacrylates, phosphates, and polyelectrolytes. Various other materials may also be incorporated into the solid composition such as borates, carbonates, chlorine sources, and surfactants/defoamers.

The formulation and production of cast solid detergent compositions has, however, presented problems. In one prepratory protocol, a cast solid is produced by heating an alkaline source material to a temperature at which it becomes a molten solution and adding the remaining detergent compounds. The molten solution is then cooled until solidification occurs. Another typical approach is to allow a solution containing an alkaline source material to solidify by virtue of water of hydration. However, many of the detergent components are not chemically stable with one another at the elevated temperatures necessary for formulating solid detergents by the molten technique, or even at the lower required temperature for solidification by water of hydration. For example, Applicant has found that the addition of phosphates to a solution containing caustic at about 160° F. will lead to the reversion of the phosphate to a form which is not satisfactory to condition hard water.

A solid detergent composition is discussed in U.S. Re. 32,818 in which a plurality of chemical plugs are used to isolate incompatible chemicals. However, these plugs develop a water film over their surfaces upon the end of a wash cycle, thus the chemical surfaces are allowed to interreact. This interreaction can lead to the degradation of the phosphate sequestering agent when it is in proximity to the caustic chemicals. A solid detergent dispenser is discussed in U.S. Pat. No. 4,426,362 in which the dispenser may be partitioned by means of a dividing wall. However, the separation of the alkaline component and any phosphate-based sequestering agents is not disclosed.

The present invention is directed to addressing these and other problems associated with alkaline detergents. The present invention fulfills a long-felt need in the ware washing art by providing a solid cast detergent composition in which the incompatible chemical constituents of the composition are effectively separated thus prohibiting inter-surface reactions that can degrade the detergent composition.

SUMMARY OF THE INVENTION

The present invention is directed to a detergent package for use in ware and hard surface washing. The detergent package contains a solid cast alkaline detergent which contains an alkaline chemical selected from the group consisting of alkali metal hydroxides and alkali metal silicates. The detergent also contains a phosphate-based sequestering agent. The detergent is housed in a multi-chambered container which surrounds the cast detergent, preferably on all but one surface thereof, and separates the phosphate-based sequestering agent from the alkaline chemical. The container is designed such that the residual water remaining on the surface of the detergent composition after a wash cycle is prohibited from communicating between the alkaline chemical and the phosphate-based sequestering agent. In this way, the damp detergent surfaces of the alkaline chemical and the sequestering agent cannot interreact and thus degrade the ability of the sequestering agent to function properly. The solid detergent can also contain various other detergent ingredients such as: borates, carbonates, surfactants/defoamers, chlorine sources, rosins, and non-phosphate-based sequestering agents such as polyacrylates and polyelectrolytes.

The subject invention provides a warewashing detergent package which is safe to handle and use. Being encased on all but one surface, the detergent package reduces the risk of the detergent coming into contact with the body. The cast detergent, which is a solid at room temperature, will reduce the likelihood of detergent spillage prior to its use. The multi-chambered container also serves to separate the components of the detergent composition by the compartments according to chemical compatibility. In practice, such detergent compounds such as the sequestering agent, the surfactant/defoamer, or the chlorine source are kept in chambers within the container structure from the alkaline chemical.

DETAILED DESCRIPTION OF THE INVENTION

The present invention is particularly useful as a detergent package for use in ware and hard surface washing applications. The invention provides a solid, cast, alkaline detergent composition within a multi-chambered container surrounding the cast detergent, preferably on all but one surface thereof. The cast detergent is a solid at room temperature and easily dissolves in heated wash fluid.

Figure 1:
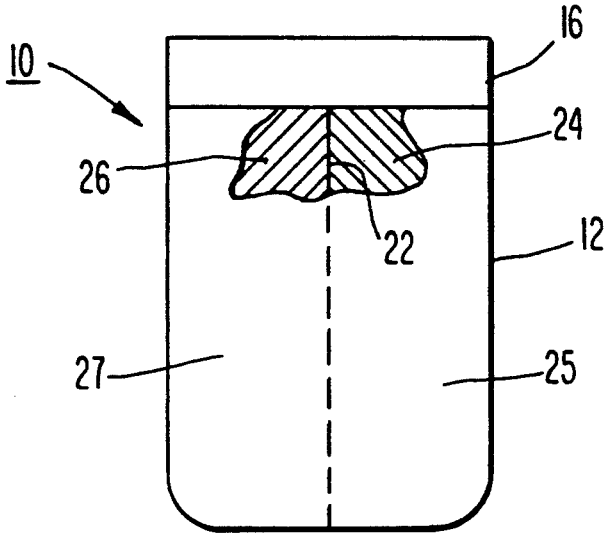
FIG. 1 is a side view of the package device of the invention having two chambers with a partial cut-away view.

The present invention can be readily understood by reference to the accompanying drawings which are provided for informative purposes and are not to be construed as limitations upon the invention. FIG. 1 shows the package 10 with a partial cut-away revealing a detergent composition shown as a cast detergent 24 and a sequestering agent 26. The package 10 is defined by the container 12 and lid 16.

The container 12 is preferably made of a material which is capable of withstanding the highly alkaline cast detergent 24 and the elevated temperatures which may exist during the production of the cast detergent 24 in the container 12 and during a washing operation. The lid 16 may either be a screw-top containment seal or a plastic material held to the container 12 by means of an adhesive. The lid 16 is preferably made from the same material as the container 12. The container 12 and lid 16 are most preferably made from a thermoplastic material which is easily molded into any configuration, although metals can also be used as the material of construction. The container 12 and lid 16 may be made of any dimension to fit any of a wide variety of dispensing systems already in commerce.

The package 10 is used by inserting the package 10 into a dispensing system which directs a wash fluid over the surface of the package 10. The wash fluid therefore dissolves the surface of the cast detergent 24 and sequestering agent 26 carrying the detergent compounds into the wash solution. Examples of dispensing systems are shown in U.S. Pat. No. 4,426,362 to Copeland et al. and U.S. Pat. No. 3,727,889 to Nagel, the disclosures of each of which are incorporated herein by reference in their entirety.

The cast detergent 24 can be a mixture of several detergent compounds. The cast detergent 24 contains alkaline source compounds such as alkali metal hydroxides and silicates and combinations thereof. A preferred silicate is orthosilicate, although metasilicate and sesquisilicate may also be employed. Most preferably, the alkali metal silicate is a fused sodium or potassium orthosilicate, although mixed (non-fused) silicates such as mixed sodium or potassium orthosilicates can be employed. Most preferably, the silicate is sodium orthosilicate. A preferred alkali metal hydroxide is sodium hydroxide, although potassium hydroxide may also be employed. The amount of alkali metal hydroxide is preferably below 25% by weight and the amount of alkali metal silicate is preferably above about 25% by weight, based on the total weight of the detergent composition. The amount of alkali metal silicate is more preferably between about 30% to about 70% by weight based on the total weight of the detergent composition.

The detergent composition in the detergent package 10 also contains a sequestering agent 26, preferably a phosphate-based sequestering agent, for controlling the hardness of the wash fluid. The wash fluid usually will contain undesired amounts of metal such as, for example, calcium or magnesium, which should be removed from the wash fluid to enhance the effectiveness of the detersive action. Examples of typical phosphate-based sequestering agents are alkali metal phosphates such as sodium or potassium tripolyphosphate, orthophosphate, pyrophosphate, hexametaphosphate, metaphosphate, tetraphosphate, or condensed phosphoric acid of the general formula $(HPO_3)_n$ where n=3-20. Preferred phosphate-based sequestering agents are the polyphosphates such as sodium tripolyphosphate, hexametaphosphate, and tetraphosphate, more preferably sodium tripolyphosphate. The phosphate-based sequestering agent is selected such that it functions to remove the calcium and magnesium from the water, along with soils from the washed articles, and to keep these compounds from precipitating in the wash fluid. The phosphate-based sequestering agent will revert to an undesired form, a lower base state, upon exposure to the alkaline source, which form will lead to precipitation in the wash fluid. The phosphate-based sequestering agent preferably constitutes from about 1 to about 70% by weight of the total detergent composition.

The detergent composition can also contain an amount of water such that the cast is a solid at room temperature. The amount of water present in the detergent composition, including the water of hydration, is generally from about 1 to about 15% by weight although higher or lower amounts may be included.

The detergent composition can also contain any of several other detergent compounds. These compounds include: borates, preferably in an amount up to about 60% by weight, such as borax; carbonates, preferably in an amount up to about 40% by weight, such as soda ash; surfactants/defoamers, preferably in an amount up to about 10% by weight, such as those disclosed in U.S. Pat. Nos. 3,442,242 to Rue et al., 3,334,147 to Brunelle, and 3,048,548 to Martin et al., the disclosures of each of which are all incorporated herein by reference in their entirety; chlorine sources, preferably up to about 10% by weight, such as sodium chloride, or lithium hypochlorites, or chlorinated isocyanurates; rosin, preferably up to about 10% by weight; and non-phosphate-based sequestering agents, preferably up to about 20% by weight, such as polyacrylates and polyelectrolytes. Other suitable compounds useful in the present detergent composition will be readily apparent to those skilled in the art in light of the present disclosure.

A preferred detergent composition is manufactured by first mixing fused sodium orthosilicate and sodium hydroxide in the presence of water. The mixture is then heated to a temperature of about 140° to about 180° F., preferably to about 160° F. At this point, any of the other detergent compounds, except for the phosphate-based sequestering agent, may be added to the mixture. The mixture is blended together thoroughly and then poured into a chamber of a mold which may be the container 12. The phosphate-based sequestering agent is then added, with or without other compounds, to a separate chamber of the mold. The detergent compounds are then allowed to cool to room temperature and solidify as a solid cast detergent. Preferably, solidification occurs by virtue of the water of hydration.

FIG. 1 depicts a cross-sectional view of detergent package 10 having a chamber wall 22 creating multiple compartments, namely chambers 25 and 27. The chamber wall 22 is a water impermeable barrier. A chamber configuration for the container 12 is advantageous in separating detergent chemical compounds which are chemically incompatible with one another. Such chemical incompatibilities arise, for example, between the alkaline chemicals and the phosphate-base sequestering agents, between the alkaline chemicals and the surfactant/defoamers, and also between the alkaline chemicals and the chlorine sources. Depending upon the specific formulation needed for any application, it may be desirous to separate several of the detergent compounds. This separation is necessary to prevent the interreaction between the surfaces of these incompatible chemicals, especially during the periods between wash cycles when the surfaces are damp and where such interreaction can lead to degradation of the detergent composition.

Referring to FIG. 1, a typical detergent package may be prepared where the phosphate-based sequestering agents 26 are separately provided in chamber 27 while the alkaline chemical and other detergent compounds 24 are blended together and poured into chamber 25, in the manufacturing process. The container 12 serves as the mold for this configuration. The exposed surface area of chamber 24 and 26 would be proportional to the volumetric proportion of the detergent compositions contained therein to ensure proportional dissolution during the use of the package 10.

Figure 2:
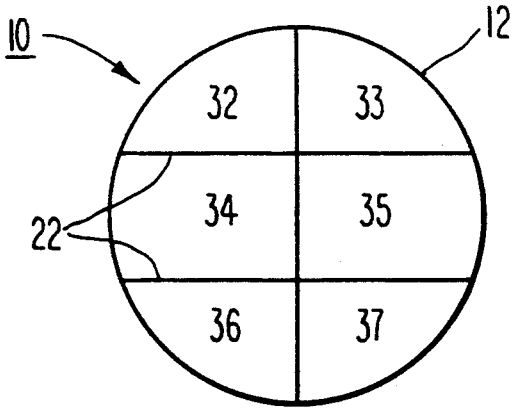
FIG. 2 is a top cross sectional view of the package device of the present invention having six chambers.

FIG. 2 depicts a top cross-sectional view of a detergent package 10. The container 12 is again defined by chamber walls 22 which create six chambers 32, 33, 34, 35, 36, and 37. This type of container arrangement is beneficial in those instances where it is desired to separate several of the detergent compounds which are to be within the cast detergent. Each one of the chambers 32, 33, 34, 35, 36, and 37 can contain a separate detergent compound such as the alkaline chemical, the sequestering agent, the borate, the carbonate, the surfactant-/defoamer, the chlorine source, the rosin, the polycarbonate, or the polyelectrolyte. The detergent compounds are again poured into the chambers compartments 32, 33, 34, 35, 36, and 37 during the manufacturing process with the container 12 acting as the mold. The number of compartments can vary according to the demands required by a specific use. In one embodiment, the detergent composition contains the alkaline chemical, the phosphate-based sequestering agent, and the surfactant/defoamer, and each component is maintained in a separate container, thus necessitating at least three chambers in the package 10. A further embodiment incorporates a chlorine source in a package 10 containing at least four chambers. Again, the surface area of each compartment is proportional to the volume fraction which the detergent composition contained within that compartment has with respect to the overall cast detergent.

The volume of the different chambers may be unequal. In the preferred embodiment, the volume of each chamber is proportional to the weight percentage of detergent compound within the chamber in relation to the overall detergent in the receiver.

The following provides a prophetic example of the production of a cast detergent product of the present invention.

EXAMPLE

A mixing container is supplied with 55.5 weight percent of fused sodium orthosilicate. To this is added 25.0 weight percent of sodium hydroxide. The fused orthosilicate and the sodium hydroxide are mixed together and heated. The mixture is brought to a temperature of 160° F. At this point 3.0 weight percent of water, 0.5 weight percent of surfactant/defoamer, 3.0 weight percent of polyacrylate, and 3.0 weight percent of rosin are added to the mixture. The mixture is thoroughly blended and then poured into a mold. The mold is separated into two chambers such that the volume of the mold is in a ratio of 90:10 between the two chambers. The alkali mixture is poured into the larger volume portion of the mold. A solution of 10 by weight percent sodium tripolyphosphate is poured into the smaller volume portion of the mold. The mold is allowed to cool to room temperature and solidify.

What is claimed is:

1. A multi-cycle machine washing detergent package for use in ware and hard surface washing that contains a solid detergent composition having an alkaline detergent portion separated from a phosphate-based sequestering agent by a water impermeable barrier comprising:

(a) a first chamber comprising a solid, cast alkaline detergent in an amount sufficient for multiple cycle washings, having a first exposed surface comprising:

an alkaline chemical selected from the group consisting of up to 25% by weight of the composition of alkali metal hydroxides and from about 30–70% by weight of the composition of alkali metal silicates and provided that the first chamber is free of a phosphate-based sequestering agent;

(b) a second chamber comprising from about 1–70% by weight of the composition of a solid, cast phosphate-based sequestering agent in an amount sufficient for multiple cycle washings, having a second exposed surface for controlling the hardness of the washing fluid and provided that the second chamber is free of an alkaline chemical;

(c) a water impermeable barrier between said first and second chambers, said barrier preventing interreaction between the first and second surfaces; and (d) a container encompassing said first and second chambers and exposing at least one surface of said first and second chambers, wherein residual water remaining on the surface of the detergent composition after a wash cycle is prohibited from communicating between the alkaline chemical and the phosphate-based sequestering agent.

2. The detergent package of claim 1 wherein the alkali metal silicate is fused sodium orthosilicate.

3. The detergent package of claim 1 wherein the detergent composition further contains at least one compound selected from the group consisting of: borates, carbonates, surfactants, chlorine sources, rosins, polyacrylates and polyelectrolytes.

4. The detergent package of claim 3 wherein the container is the mold in which the cast was solidified.

5. The detergent package of claim 3 wherein the container comprises at least three chambers, said chambers separated by a water impermeable barrier.

6. The detergent package of claim 5 wherein the detergent composition further comprises a surfactant and wherein the alkaline chemical, the phosphate-based sequestering agent, and the surfactant are each in separate chambers of the container.

7. The detergent package of claim 6 wherein the detergent composition further comprises a chlorine source and wherein the container comprises at least four chambers separated by a water impermeable barrier and the alkaline chemical, the phosphate-based sequestering agent, the surfactant, and the chlorine source are each in separate chambers of the container.

8. The detergent package of claim 1 wherein the container encloses said first and second chambers on all but one surface.

9. The detergent package of claim 6 wherein the container encloses said chambers on all but one surface.

10. The detergent package of claim 7 wherein the container encloses said chambers on all but one surface.

11. A multi-cycle machine washing detergent package for use in ware and hard surface washing that contains a solid detergent composition having an alkaline detergent portion separated from a phosphate-based sequestering agent by a water impermeable barrier comprising:

(a) a first chamber comprising a solid, cast alkaline detergent in an amount sufficient for multiple cycle washings, having a first exposed surface comprising:

up to about 25 weight percent, based upon the detergent composition, of an alkali metal hydroxide and from about 30 to about 70 weight percent, based upon the detergent composition, of an alkali metal silicate, wherein the first chamber is free of a phosphate-based sequestering agent;

(b) a second chamber consisting of from about 1 to about 70 weight percent, based upon the detergent composition, of a solid, cast phosphate-based sequestering agent that is present in an amount sufficient for multiple cycle washings, having a second exposed surface for controlling the hardness of the washing fluid and provided that the second chamber is free of an alkaline chemical;

(c) a water impermeable barrier between said first and second chambers, said barrier preventing interreaction between the first and second surfaces; and (d) a container encompassing said first and second chambers and exposing at least one surface of said first and second chambers, wherein residual water remaining on the surface of the detergent composition after a wash cycle is prohibited from communicating between the alkaline chemical and the phosphate-based sequestering agent.

12. The detergent package of claim 11 wherein the container exposes only one surface of the chambers.

13. The detergent package of claim 11 wherein the detergent composition further contains at least one compound selected from the group consisting of: borates, carbonates, surfactants, chlorine sources, rosins, polyacrylates and polyelectrolytes.

14. The detergent package of claim 13 wherein the detergent composition further comprises a surfactant and wherein the container comprises at least three chambers and the alkaline chemical, the phosphate-based sequestering agent, and the surfactant are each in separate chambers of the container.

15. The detergent package of claim 14 wherein the detergent composition further comprises a chlorine source and wherein the container comprises at least four chambers and the alkaline chemical, the phosphate-based sequestering agent, the surfactant, and the chlorine source are each in separate chambers of the container.

* * * * *

UNITED STATES PATENT AND TRADEMARK OFFICE

CERTIFICATE OF CORRECTION

PATENT NO. : 5,318,713

DATED : June 7, 1994

INVENTOR(S) : Randolph K. Binter

It is certified that error appears in the above-indentified patent and that said Letters Patent is hereby corrected as shown below:

Column 4, line 20, insert —U.S. Pat. No.—after "Rue et al.".
line 21, insert —U.S. Pat. No.—before "3,048,548".

Signed and Sealed this

Thirteenth Day of June, 1995

Bruce Lehman

*Attest:*

BRUCE LEHMAN

*Attesting Officer*

*Commissioner of Patents and Trademarks*